United States Patent [19]

Fontana et al.

[11] Patent Number: 5,046,887

[45] Date of Patent: Sep. 10, 1991

[54] GUTTERED PAVING BLOCKS

[76] Inventors: John D. Fontana, 21 Pine Ridge Dr., Smithtown, N.Y. 11787; William Emery, Jr., 27 Fry Blvd., Patchogue, N.Y. 11772

[21] Appl. No.: 563,045

[22] Filed: Aug. 6, 1990

[51] Int. Cl.[5] ..... E01C 5/00

[52] U.S. Cl. ..... 404/34; 404/41

[58] Field of Search ..... 404/34, 40-42

[56] References Cited

U.S. PATENT DOCUMENTS

| | | | |
|---|---|---|---|
| 499,739 | 4/1891 | Hazelton | 404/41 |
| 2,919,634 | 1/1960 | Plotner | 404/42 |
| 4,128,357 | 12/1978 | Barth et al. | 404/41 |
| 4,168,140 | 9/1979 | Fontana et al. . | |
| 4,354,773 | 10/1982 | Noack | 404/41 |
| 4,544,305 | 10/1985 | Hair | 404/34 |
| 4,850,739 | 7/1989 | Gargollo | 404/41 |

FOREIGN PATENT DOCUMENTS

| | | | |
|---|---|---|---|
| 2707558 | 8/1978 | Fed. Rep. of Germany | 404/42 |
| 960465 | 2/1948 | France | 404/40 |
| 1534552 | 7/1968 | France | 404/42 |
| 2315216 | 6/1976 | France | 404/41 |
| 7415523 | 11/1974 | Netherlands | 404/42 |

*Primary Examiner*—Bruce M. Kisliuk
*Assistant Examiner*—Roger J. Schoeppel
*Attorney, Agent, or Firm*—Leonard Belkin

[57] ABSTRACT

A guttered paving block which can interlock with identical paving blocks in only one way to simply the assembly of a ground cover consisting of a square narrow waisted portion and a pair of oppositely situated extended head portions with pointed ends. The narrow waist portion makes the block easy to pick up with one hand. Dummy grooves which are parallel are provided to facilitate the manufacture of the block. Another embodiment is designed to permit a large number of patterns when assembled. It consists of a rectangular portion with a smaller square portion appended to one side of the rectangular portion.

4 Claims, 4 Drawing Sheets

GUTTERED PAVING BLOCKS

BACKGROUND OF THE INVENTION

The present invention relates to paving blocks and more particularly to paving blocks which are simple to install and maximize interlocking strength.

Paving blocks, also known as slab elements or ground covering elements, are employed generally and assembled as ground covers in such areas as patios, walks, driveways, and other areas where a firm but decorative surface is desired or required. The blocks are usually made from concrete or cement poured into molds having the desired shape.

Paving blocks are usually assembled and put in place by hand so that the cost of installation is usually the major cost of such construction. In addition, over a period of time, due to settling or other conditions, it is not unusual for the blocks to separate, tending to come apart.

A number of United States Patents show a variety of paving blocks.

U.S. Pat. No. 449,739 discloses a paving block which can be assembled in a variety of configurations made up of hexagonal shapes.

U.S. Pat. No. 2,919,634 shows a paving stone designed to reduce road noise caused by vehicles riding on a surface made from such stones.

U.S. Pat. No. 4,128,357 describes a slab element capable of being assembled in different ways to obtain different patterns, made up of a head portion and a stem portion.

U.S. Pat. No. 4,354,773 illustrates a ground covering element having raised elements and dummy gaps with improved drainage characteristics.

U.S. Pat. No. 4,544,305 discloses a slab element which lends itself to forming a large number of different, attractive, interlocking patterns.

U.S. Pat. No. 4,850,739 shows pavement units formed into multiple layers which are latched together by the curing of the cement.

In the paving blocks shown in the above patents, many require very careful placement by the technician because of the many ways the blocks are capable of being put together with the result that labor costs are higher in their installation.

All of the blocks shown in the above patents have shapes which make the blocks difficult to handle due either to the configuration or size, or, as in the patent to Barth et al, the block must be made small to grasp with the result that many more blocks are required to cover a given surface area.

SUMMARY OF THE INVENTION

In this invention improved paving blocks are provided which have a number of advantages over paving blocks in use up to now.

One embodiment of this invention consists of a paving block which simplifies the assembly into a ground covering without sacrificing the ornamental appearance and at the same time maximizing the interlocking strength of the units.

In this embodiment the paving blocks are shaped so that they can fit into each other only one way thereby making it possible for the worker to complete the job in much less time than when using blocks available up to now. In addition, the blocks are narrow waisted so that the worker can readily handle a block with a single hand even though size of the block is not sacrificed. In this embodiment, when dummy grooves are utilized they are all parallel to each other which reduces the cost of manufacturing these paving blocks.

In another embodiment of this invention there is provided a paving block of simple design which is capable of being assembled in a large number of different designs thereby offering a choice of designs with the use of a single paving block shape.

It is thus a principle object of this invention to provide paving blocks with improved handling and other characteristics.

Other objects and advantages of this invention will hereinafter become obvious from the following description of preferred embodiments of this invention.

DESCRIPTION OF THE PREFERRED EMBODIMENTS

Figure 1:
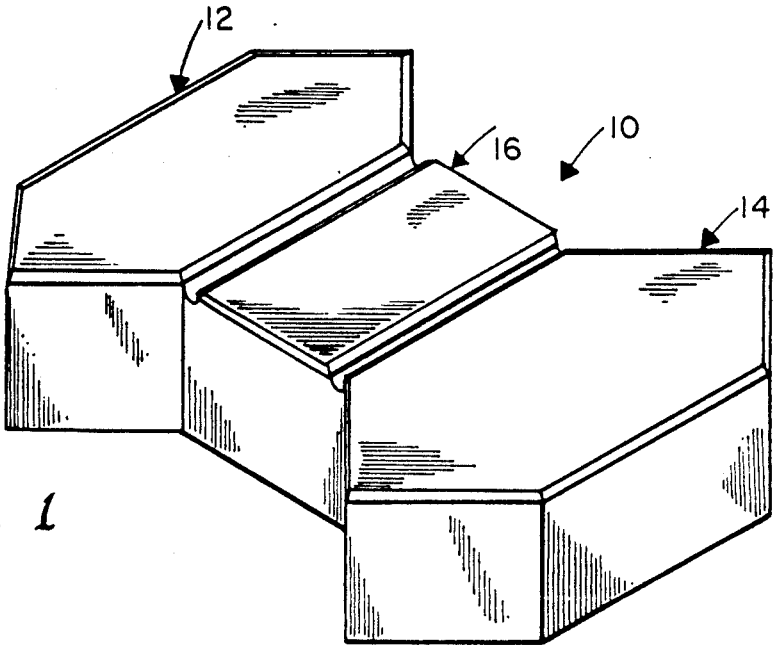
FIG. 1 is a perspective view of one paving block constructed in accordance with the principles of this invention.
Figure 2:
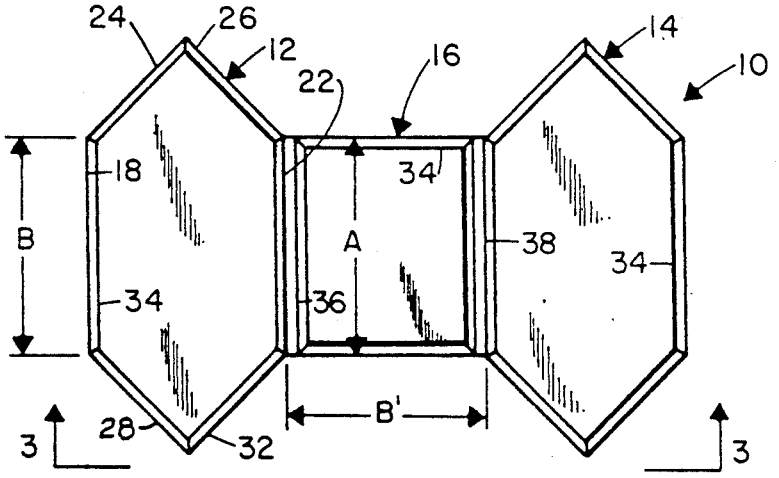
FIG. 2 is a top plan view of the block shown in FIG. 1.
Figure 3:
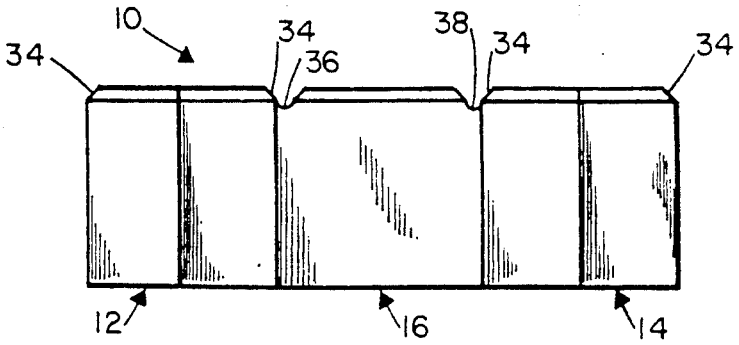
FIG. 3 is a front elevation view taken along 3—3 of the block shown in FIG. 2.

Referring to FIGS. 1-3, paving block 10 consists of a pair of head portions 12 and 14 identically shaped and joined by a narrower waist portion 16 which is sufficiently narrow along dimension A so that it can be grasped readily by the hand of a person of average size. Head portions 12 and 14 and waist portion 16 form a single, integrated paving block formed in a single mold, usually concrete.

Each of head portions 12 and 14 is constructed, as seen for head portion 12, to form a pair of parallel sides 18 and 22 which outline the head portion and pyramidal shaped straight end-walls 24, 26 and 28, 32 formed at 90 degrees with each other, and hence 45 degrees from sides 18 and 22 in the manner illustrated. This construction permits a number of identical paving blocks 10 to be assembled in the manner to be described below.

Paving block 10 is provided with chamfered top edges 34 around both of the head portions 12 and 14 and the waist portion 16.

It will be noted from FIGS. 1 and 3 in particular that paving block 10 is a single unitary structure and that head portions 12 and 14 are integral with waist portion 16. A pair of so-called dummy parallel grooves or gutters 36 and 38 as understood in the art separate head portions 12 and 14 from waist portion.

The use of grooves 36 and 38 which are parallel with each other, and block 10 having no grooves or gutters which are not parallel with grooves 36 and 38, is an important aspect of this invention. When paving block 10 as well as other paving blocks are manufactured, concrete is poured into a mold and a press plate with protrusions extending downwardly is placed over the opening to produce the grooves. This arrangement is shown in my U.S. Pat. No. 4,168,140 issued on Sept. 18, 1979. A brush or a squeegee mounted on the edge of the feed drawer is employed to clean the press plate prior to each use as the feed drawer is slid off the open top of the mold. With the use of parallel grooves, there are no protrusions behind which there can be a buildup of concrete, so that hand wiping of the plate clean is avoided hence, less time is required to refill the mold. In the event protrusions extend in other than the direction of the wiping, this method of cleaning the press plate can not be utilized necessiting a worker to clean the press plate after each use. The construction of the block as just described makes it more economical to produce in the quantities required for its intended use.

Figure 4:
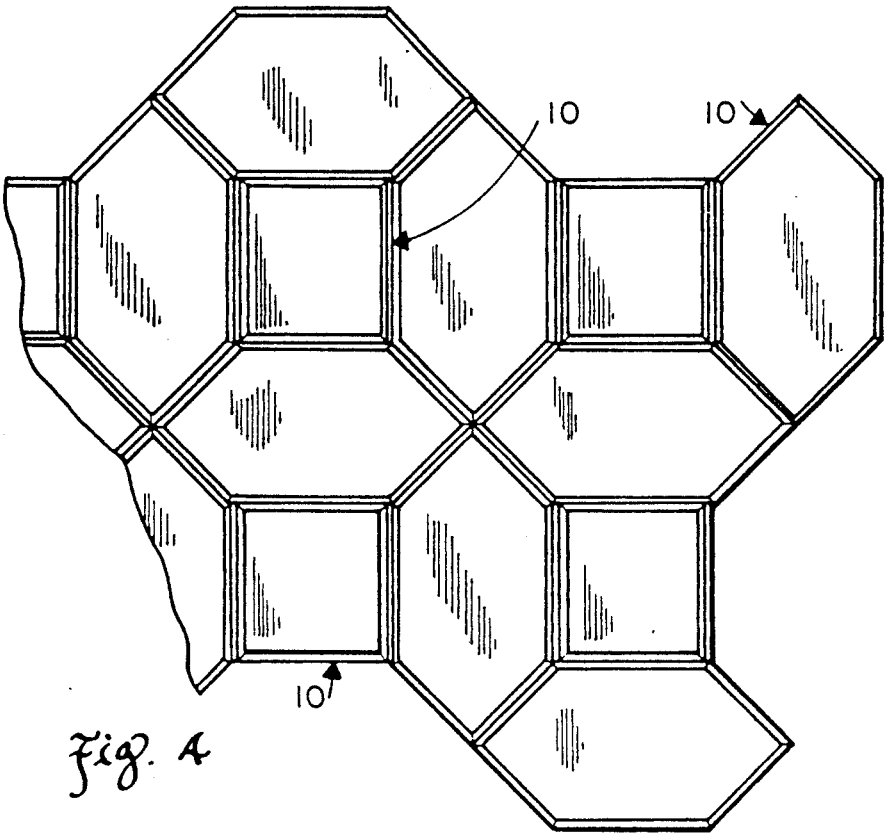
FIG. 4 is a top plan view of a plurality of paving blocks of the shown in FIGS. 1-3 arranged to form a pavement.
Figure 5:
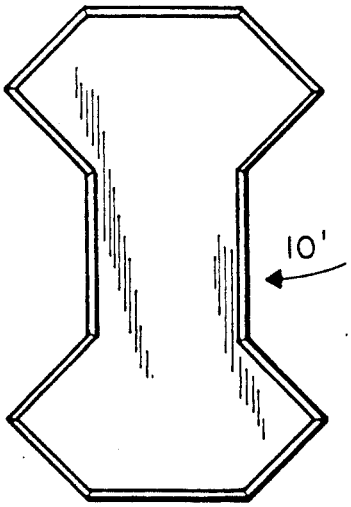
FIG. 5 is a top plan view of the paving block shown in FIGS. 1-3 without the dummy grooves.

The design of paving block 10 has other important advantages. As is seen in FIG. 4, there is only one way that blocks 10 can be assembled together to form the ground cover, dimensions B and B' being equal. Since the worker does not have to be concerned with whether he is forming the correct pattern he can work faster and thus the cost of installing such a cover will be significantly less. In addition, the narrowness of waist portion 16 being such that block 10 can be lifted using one hand, the worker can assemble more blocks in a given period of time because each hand can hold a single block rather than using two hands to handle each paving block.

Figure 6:
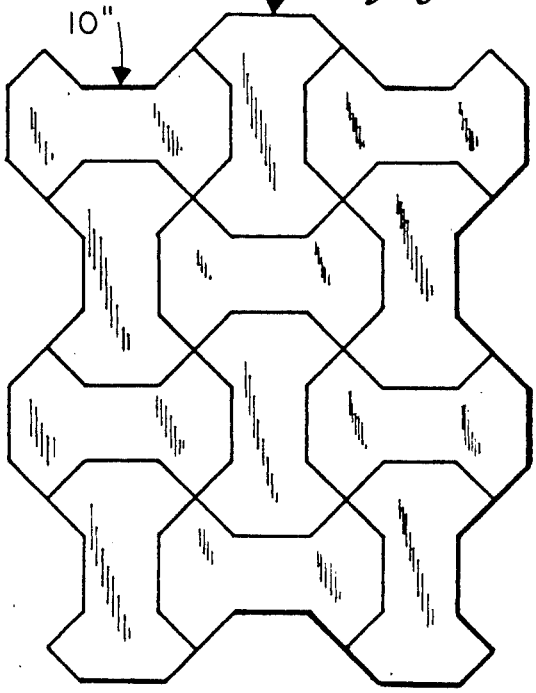
FIG. 6 is a top plan view of a plurality of the paving blocks shown in FIGS. 1-3 without chamfers or grooves.

The use of chamfers 34 and grooves 36 if desired of course can be eliminated, and under some circumstances the pattern might call for no grooves, in which case the pattern would look like that shown in FIG. 6, using blocks 10' identical to blocks 10 except for the absence of the chamfers and the grooves. FIG. 6 shows an identical block 10'' with chamfers but without grooves.

Figure 7:
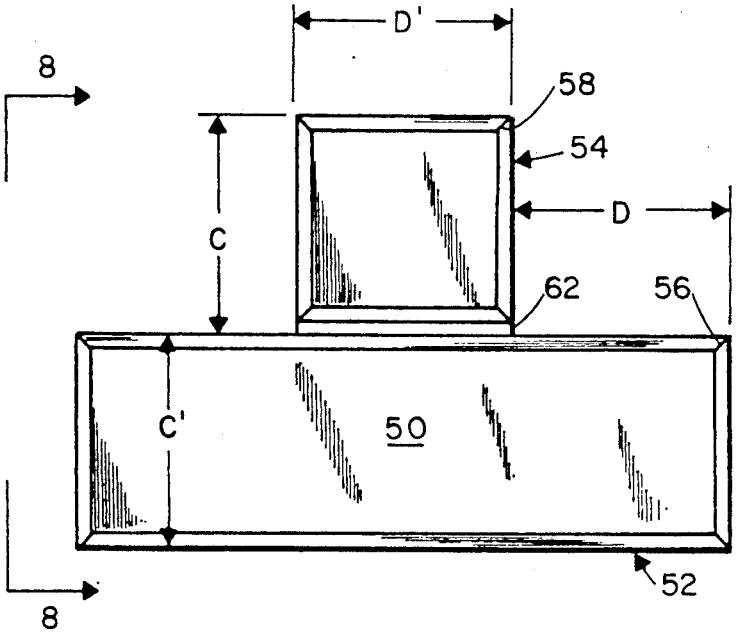
FIG. 7 is a top plan view of another embodiment of a paving block constructed in a manner to permit the formation of a large number of different patterns depending how blocks of this construction are assembled.
Figure 8:
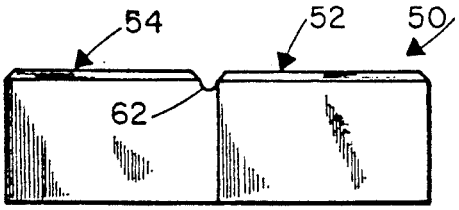
FIG. 8 is an end view taken along 8—8 of FIG. 7.
Figure 9:
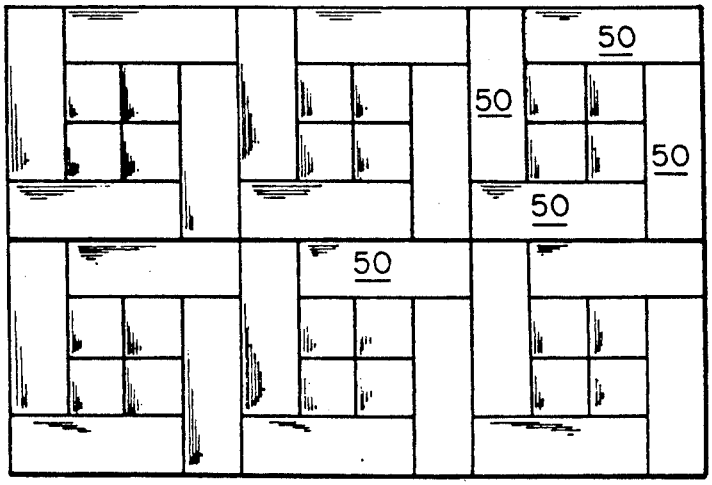
FIGS. 9, 10, 11, and 12 show a variety of patterns which can be formed with the paving block shown in FIGS. 7 and 8.
Figure 10:
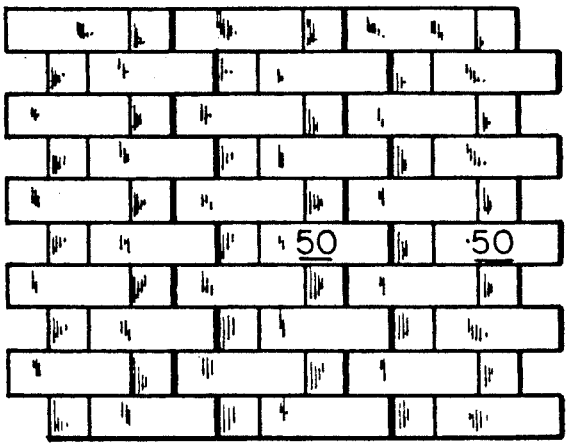
Figure 11:
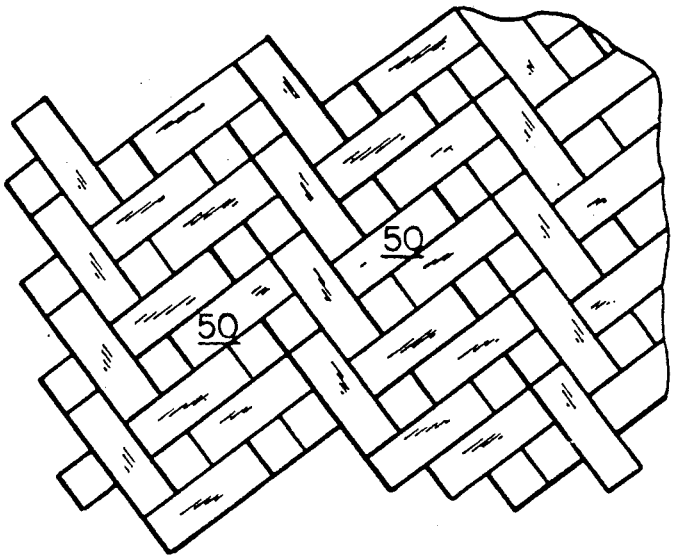
Figure 12:
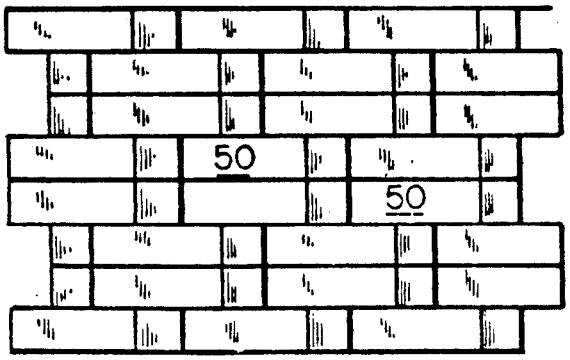

Under some circumstances it is desirable to have a paving block capable of forming a number of different patterns. Such a paving block 50 is shown in FIGS. 7 and 8. Block 50 consists of a rectangular main portion 52 and a square stem portion 54. Both portions are provided with chamfers 56 and 58, respectively. A dummy groove 62 is provided between the two portions. With a single groove parallel to one side of the main portion, the advantage of cleaning the press plate with the brush mentioned earlier is obtained.

It will also be noted that the size of stem portion 54 is such that it is square with groove 62 occupying part of the former so that dimensions C and C' are identical in order to obtain a variety of patterns as will be described. In addition, dimensions D and D' are identical to each other and to dimensions C and C' as well.

This construction makes it possible to have the variety of patterns shown in FIGS. 9, 10, 11, and 12 shown without grooves or chambers for simplicity.

It is thus seen there has been provided paving block constructions having certain improved advantages in manufacture and assembly.

While only certain preferred embodiments of this invention have been described it is understood that many variations are possible without departing from this invention as described in the claims which follow:

What is claimed is:

1. A paving block for covering a surface by interlocking with other paving blocks each identical to said paving block, said block being a solid body comprising:

a. a pair of identical head portions each of which has a pair of parallel opposite sides the length of which is equal to the distance between said parallel sides, each said head portion closed at each end of said parallel sides by straight edges coming together to a point at right angles to each other; and b. a waist portion of square shape joining said head portions, one parallel side of each head portion forming one side of said waist portion, the two head portions being on opposite sides of said waist portion whereby the only way said paving block can interlock fully with any other identical paving block is where a parallel side of a head portion is nestled against one side of a waist portion of an adjacent paving block and the straight edges adjacent said parallel side rest against straight edges of the adjacent block, said head and waist portions forming a surface on opposite sides of said body being narrower across said waist portion than the lengths of said head portions measured from the points at opposite ends where said straight edges come together, all edges along one surface are chamfered including chamfers along said head and waist portions adjacent each other and gutters formed between the head and waist chamfers, said gutters extending below the bottom edges of the chamfers.

2. The paving block of claim 1 wherein the width across said waist member is no greater than which could be grasped by a single hand of an average sized person.

3. A paving block for covering a surface by interlocking with other paving blocks each identical to said paving block, said block being a solid body comprising:

a. a rectangular main portion;

b. a square stem portion extending from one of the long sides of said rectangular main portion, each side of said square stem portion having the same length as the width of said rectangular portion, the length of said rectangular portion being three times the length of each side of said stem portion, said stem portion being located at the midpoint of the aforesaid long side of said rectangular main portion; and c. a gutter formed in said stem portion parallel to said one side of said main portion.

4. The paving block of claim 3 having chamfered edges.

* * * * *